US009091414B2

(12) United States Patent
Yang

(10) Patent No.: US 9,091,414 B2
(45) Date of Patent: Jul. 28, 2015

(54) PENDANT DEVICE HAVING LASER-ENGRAVED PATTERN

(71) Applicant: Chin-Sheng Yang, Tainan (TW)

(72) Inventor: Chin-Sheng Yang, Tainan (TW)

( * ) Notice: Subject to any disclaimer, the term of this patent is extended or adjusted under 35 U.S.C. 154(b) by 201 days.

(21) Appl. No.: 13/802,825

(22) Filed: Mar. 14, 2013

(65) Prior Publication Data

US 2014/0268705 A1 Sep. 18, 2014

(51) Int. Cl.

| | |
|---|---|
| ***F21V 3/00*** | (2006.01) |
| ***F21V 3/04*** | (2006.01) |
| ***A47G 33/08*** | (2006.01) |
| ***F21S 9/02*** | (2006.01) |
| *F21W 121/00* | (2006.01) |
| *F21Y 113/00* | (2006.01) |

(52) U.S. Cl.

CPC ..... *F21V 3/049* (2013.01); *A47G 33/08* (2013.01); *F21S 9/02* (2013.01); *F21V 3/0409* (2013.01); *F21W 2121/00* (2013.01); *F21Y 2113/007* (2013.01)

(58) Field of Classification Search

CPC . F21W 2121/00; F21W 2121/04; F21V 3/00; F21V 21/0832

USPC ..... 362/311.13, 806, 186

See application file for complete search history.

(56) References Cited

U.S. PATENT DOCUMENTS

| | | | | |
|---|---|---|---|---|
| 4,573,108 | A * | 2/1986 | Castiglia et al. | 362/123 |
| 4,652,980 | A * | 3/1987 | Segan | 362/806 |
| 5,266,771 | A * | 11/1993 | Van Wyk | 362/806 |

* cited by examiner

*Primary Examiner* — William Carter

(74) *Attorney, Agent, or Firm* — Leong C. Lei

(57) ABSTRACT

The pendant device contains the following components. A base member contains a power element having at least a battery to provide electricity to the pendant device. A lighting member is configured on top of and electrically connected to the power element of the base member. A hollow, transparent, and spherical shell member is made of a plastic material and is joined to the base member. The shell member has a bottom opening and a graphical pattern formed by laser engraving on the shell member's circumferential wall. The lighting member is mainly housed inside the shell member. A cap member is configured on top of the shell member. The cap member has a hanging element which is a ring-shaped spring. The hanging element allows the pendant device to be conveniently hung from all places. The hook element can be used to hang objects such as a Christmas stocking.

6 Claims, 5 Drawing Sheets

PENDANT DEVICE HAVING LASER-ENGRAVED PATTERN

TECHNICAL FIELD OF THE INVENTION

The present invention is generally related to pendant devices, and more particular to a pendant device having a laser-engraved graphical pattern.

DESCRIPTION OF THE PRIOR ART

In order to fulfill various desires of customers, today's products are required to provide multiple functions. Taking the household lamps as examples, their visual appearances are a vital buying decision in addition to their illumination function. Furthermore, the lamps are often required to have different shapes and styles so as to be compatible with the other furniture and to achieve a consistent interior design. Versatility is therefore a major focus of lamp manufacturers.

SUMMARY OF THE INVENTION

Therefore, a pendant device having a laser-engraved graphical pattern is provided herein. The pendant device contains the following components.

A base member contains a power element having at least a battery to provide electricity to the pendant device. A hook element is configured to a lateral side of the base member and a removable piece is joined to a bottom side of the base member so as to expose the battery.

A lighting member is configured on top of and electrically connected to the power element of the base member.

A hollow, transparent, and spherical shell member is made of a plastic material and is joined to the base member. The shell member has a bottom opening and a graphical pattern formed by laser engraving on the shell member's circumferential wall. The lighting member is mainly housed inside the shell member.

A cap member is configured on top of the shell member. The cap member has a hanging element which is a ring-shaped spring. The two end of the hanging element are threaded through and locked to two holes on a top side of the cap member so that the pendant device can be hung by the cap member.

The hanging element allows the pendant device to be conveniently hung from all places so that the pendant device can provide decorative or ornamental function. In addition, the hook element can be used to hang objects such as a Christmas stocking. The pendant device therefore achieves both decorative and utility functions.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
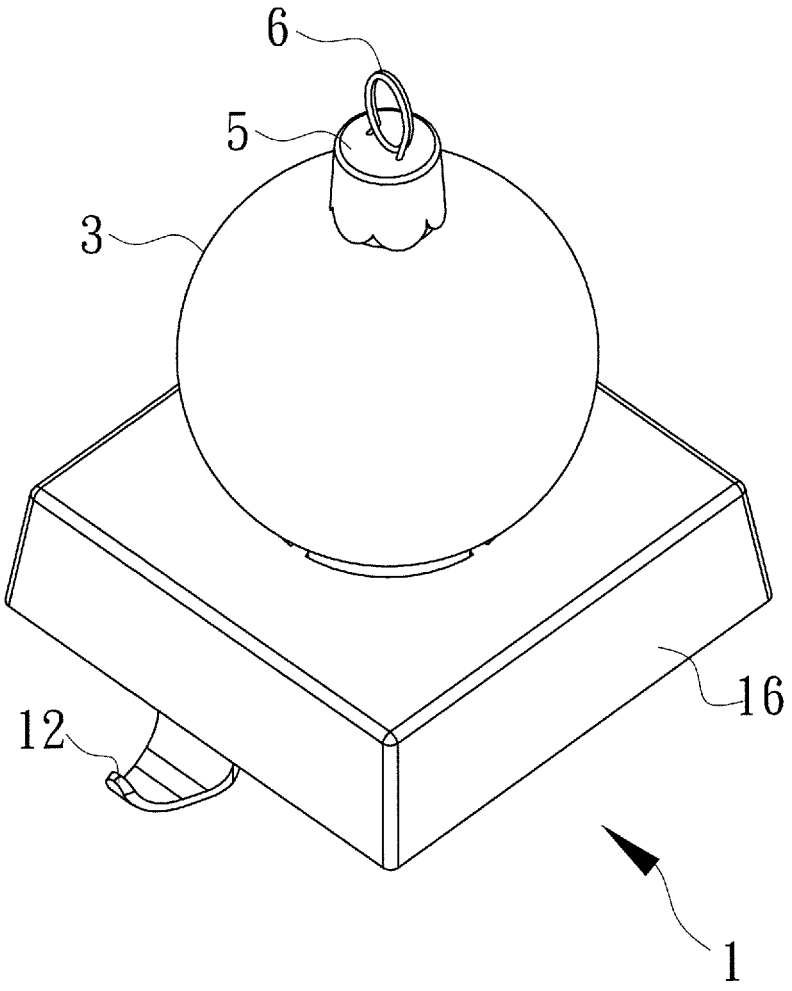
FIG. 1 is a downward perspective diagram showing a pendant device according to an embodiment of the present invention.
Figure 2:
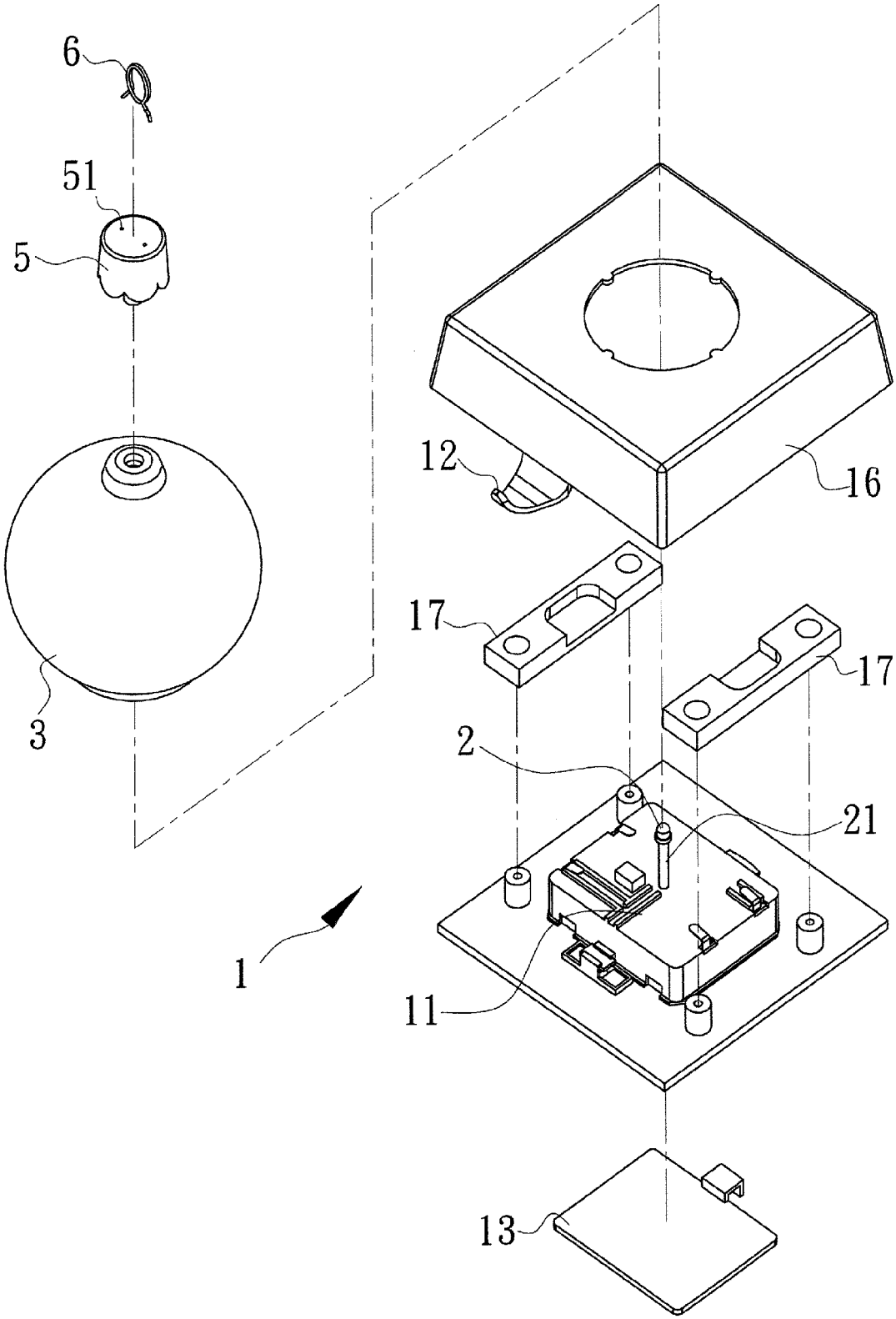
FIG. 2 is a perspective break-down diagram showing the various components of the pendant device of FIG. 1.
Figure 3:
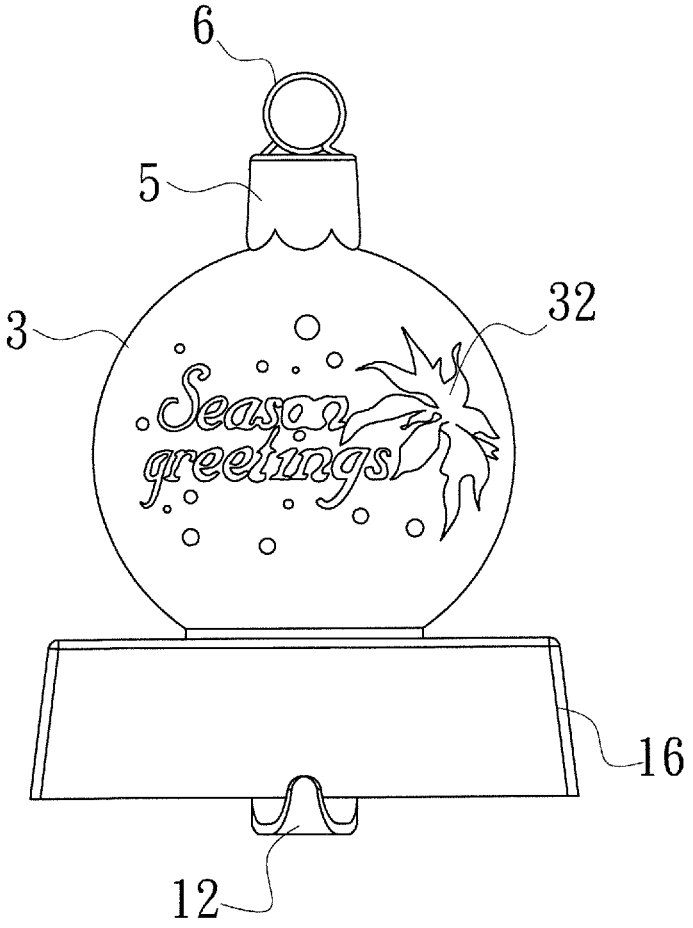
FIG. 3 is a profile diagram showing the pendant device of FIG. 1.
Figure 4:
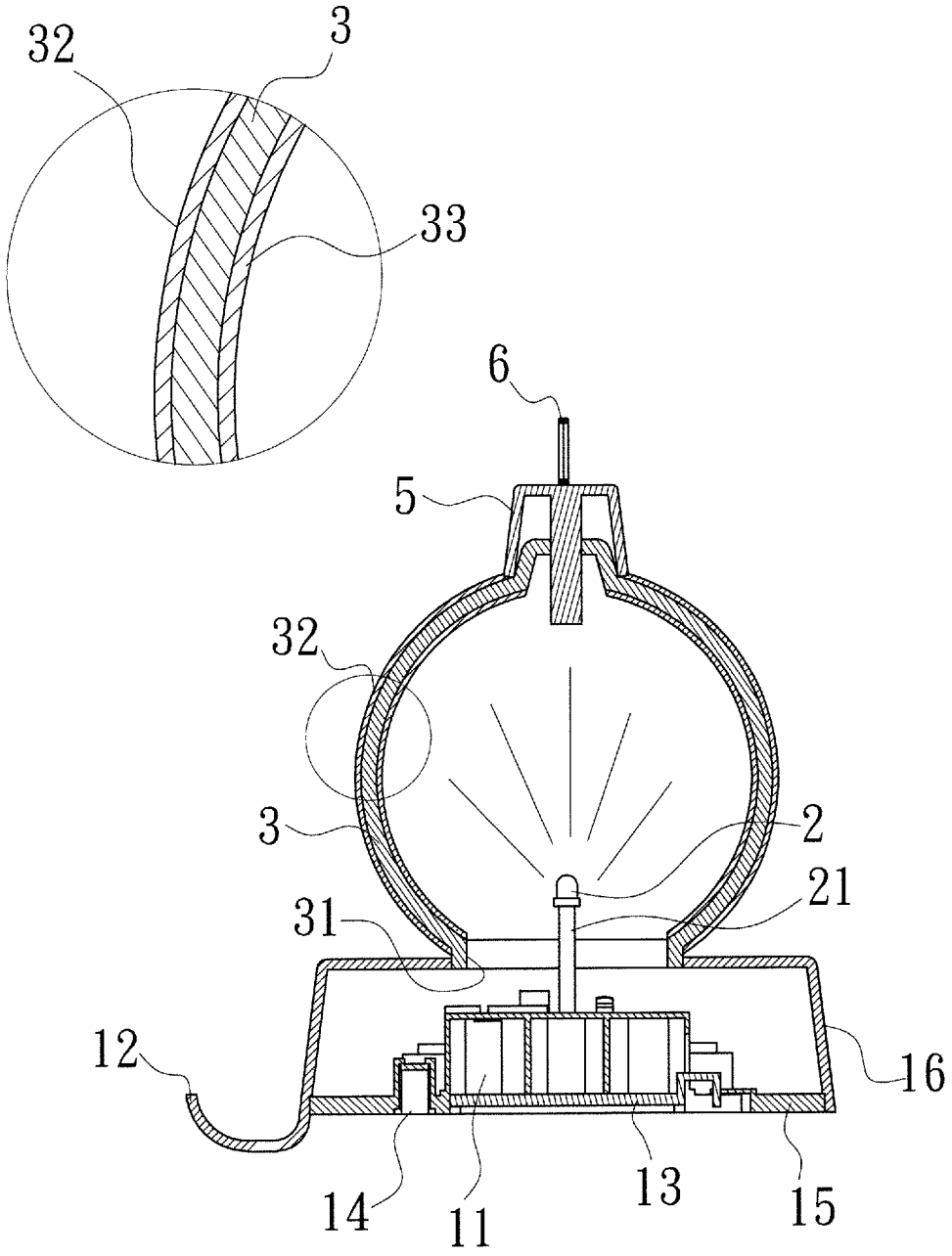
FIG. 4 is a sectional diagram showing the pendant device of FIG. 1.
Figure 5:
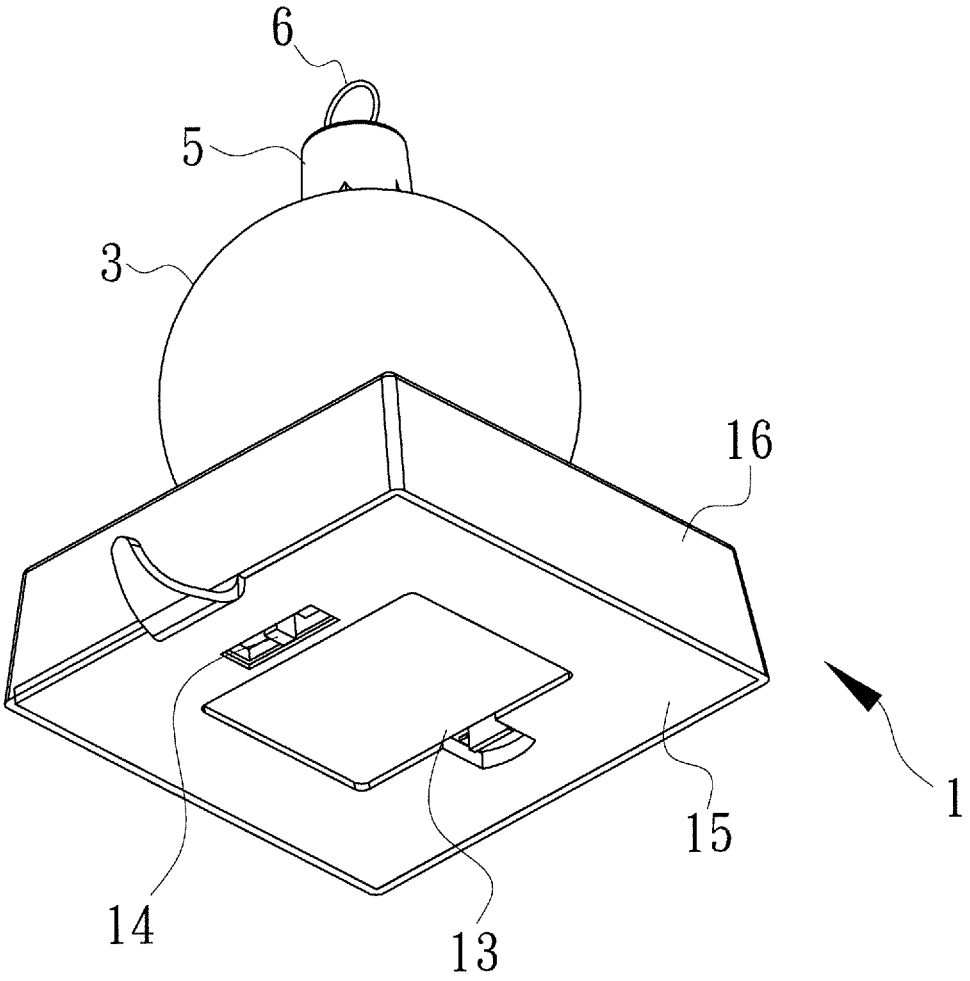
FIG. 5 is an upward perspective diagram showing the pendant device of FIG. 1.

As illustrated in FIGS. 1 to 5, a pendant device according to an embodiment of the present invention mainly contains the following components.

A base member 1 contains a power element 11 having at least a battery to provide electricity to the pendant device.

A lighting member 2 is configured on top of and electrically connected to the power element 11 of the base member 1.

A hollow, transparent, and spherical shell member 3 is made of a plastic material and is joined to the base member 1. The shell member 3 has a bottom opening 31, and a graphical pattern 32 formed by laser engraving on the shell member 3's circumferential wall.

A cap member 5 is configured on top of the shell member 3. The cap member 5 has a hanging element 6 which is a ring-shaped spring. The two end of the hanging element 6 are threaded through and locked to two holes 51 on a top side of the cap member 5 so that the pendant device can be hung by the cap member 5.

In the present embodiment, the base member 1 further contains a base plate 15 and a top cover 16. The power element 11 is configured on the base plate 15 and, as the base plate 15 is joined to a bottom side of the top cover 16, the power element 11 is housed inside the base member 1. The base plate 15 has a removable piece 13 so as to expose the battery of the power element 11 for convenient replacement. The base member 1 further has a hook element 12 joined to a lateral side of the top cover 16. The lighting member 2 contains a column 21 so as to extend vertically from a top side of the power element 11 though the top cover 16 into the shell member 3. The column 21 can also be integrally formed with the base plate 15. The lighting member 2 further contains a multi-colored LED (not numbered) on a top end of the column 21. The power element 11 further contains a control unit 111 for color sequence and on/off timing of the LED. The base member 1 further contains a switch 14 series-connected to the power element 11 for turning on and off of the lighting member 2.

The hanging element 6 allows the pendant device to be conveniently hung from all places so that the pendant device can provide decorative or ornamental function. In addition, the hook element 12 can be used to hang objects such as a Christmas stocking. In order to keep the balance of the pendant device, one or more weights 17 can be configured inside the base member 1 when some object is hung on the hook element 12.

The graphical pattern 32 can be formed on the internal or external surface of the circumferential wall of the shell member 3. The formation is achieved by laser-engraving a vacuum-plated or coated interior layer to hollow out the unwanted areas of the interior layer so that only the graphical pattern 32 is left. An additional color layer can be further coated on the interior layer so as to enhance the appearance of the graphical pattern 32. If the graphical pattern 32 is configured on the external surface of the shell member 3, the internal surface can be covered by a translucent decorative layer 33 made of transparent adhesive embedded with paillettes or glittery powders, or made of grit-blasted or matted transparent adhesive. The graphical pattern 32 therefore provides enriched and elevated visual and illumination effects.

The aforementioned laser engraving refers to the process of cutting the surface of an object by laser beams. Depending on the power and density of the laser beams, various effects can be achieved. Laser engraving can gasificate a coated or electroplated surface so as to reveal the material's original color.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A pendant device having a laser-engrave graphical pattern, comprising:

a base member having a power element inside the base member and a hook element configured to and extending sideways from a lateral side of the base member to serve as a hanger for hanging a stocking thereon, the power element having at least a battery to provide electricity to the pendant device, a weight being arranged inside the base member to serve as a counterweight for the stocking hung on the hook element;

a lighting member configured on top of and electrically connected to the power element of the base member; and a hollow, transparent, and spherical shell member made of a plastic material and joined to the base member, the shell member having a bottom opening and a graphical pattern formed by laser engraving on a circumferential wall of the shell member, where the lighting member is mainly housed inside the shell member.

2. The pendant device according to claim 1, wherein the base member further has a switch series-connected to the power element for turning on and off the lighting member.

3. The pendant device according to claim 1, wherein the graphical pattern is configured on an internal surface of the circumferential wall of the shell member.

4. The pendant device according to claim 1, wherein the graphical pattern is configured on an external surface of the circumferential wall of the shell member.

5. The pendant device according to claim 4, wherein the internal surface of the circumferential wall of the shell member is covered by a translucent decorative layer, which comprises paillettes of glittery powders mixed therein.

6. The pendant device according to claim 1, further comprising a cap member configured on top of the shell member, the cap member having a hanging element configured on a top side of the cap member.

* * * * *